United States Patent [19]

Galloup et al.

[11] Patent Number: 4,467,842

[45] Date of Patent: Aug. 28, 1984

[54] MAGNET WIRE WRAPPING BIT

[75] Inventors: Clifford L. Galloup, Reed City; Roger M. Bula, Big Rapids, both of Mich.

[73] Assignee: Cooper Industries, Inc., Houston, Tex.

[21] Appl. No.: 490,670

[22] Filed: May 2, 1983

[51] Int. Cl.[3] ..... B21F 3/00

[52] U.S. Cl. ..... 140/124; 242/7.17

[58] Field of Search ..... 140/124, 119, 122; 242/7.17

[56] References Cited

U.S. PATENT DOCUMENTS

| | | | |
|---|---|---|---|
| 3,781,932 | 1/1974 | Baker et al. | 140/124 |
| 3,967,661 | 7/1976 | Scoville et al. | 140/124 |
| 4,051,875 | 10/1977 | Baker et al. | 140/124 |
| 4,327,781 | 5/1982 | Zach | 140/124 |

*Primary Examiner*—Lowell A. Larson
*Assistant Examiner*—Linda McLaughlin
*Attorney, Agent, or Firm*—Hayes, Davis & Soloway

[57] ABSTRACT

A device for stripping insulation from magnet wire and wrapping the stripped wire around a terminal in a series of helical convolutions is described. The device includes the normal rotatable wrapping bit having a wire receiving groove disposed on the periphery of the bit, this groove being radially offset from a terminal receiving bore in the bit. The device includes a fixed sleeve surrounding the bit with a wire receiving slot extending outwardly therefrom. It has a hooked shaped insulation stripping edge positioned transversely of the wire path and being radially positioned inwardly from the groove. The stripping edge is angularly positioned between the groove and the wire receiving slot, this angular position controlling the tension of the magnet wire as it moves over the hook, this tension being sufficiently great to create a concentrated force at the junction between the insulation and the gripping edge so as to strip a limited portion of the insulation from the inner surface of the wire which is to be placed over the terminal by the wrapping tool, this stripping and wrapping taking place essentially simultaneously. The device is particularly adapted for stripping tenacious film insulation from magnet wire.

16 Claims, 4 Drawing Figures

MAGNET WIRE WRAPPING BIT

BACKGROUND OF THE INVENTION

The present invention relates generally to machines for interconnecting terminals with wire, and more particularly to wire wrap apparatus for stripping and wrapping wires about a terminal to form an electrical connection to the terminal. The wire wrap apparatus of the present invention has particular utility for stripping and wrapping film insulated magnet wire and will be described specifically in connection with such utility, although other uses are contemplated.

Wire wrapping tools have been widely used in the past for making connections between insulated wires and terminals. However, due to the difficulty of removing the insulating film normally used in the magnet wire these tools have not been commercially applied to the production of wire wrapped electrical connections using film insulated magnet wire. Such an insulating film is commonly formed of enamel, or a synthetic polymer fiber such as polyester, polyvinide, nylon or Teflon of 0.0001 to 0.002 mil thickness, tenaciously adhered to the metallic wire. Such a film cannot adequately be stripped, as a film, from the base wire by wrapping tools, such as those described in U.S. Pat. No. 3,781,932 to Baker, Galloup and Bos which is owned by the assignee of the present invention. The prior art devices, such as shown in the above-mentioned patent and U.S. Pat. Nos. 4,327,781 to Zach; 4,051,875 to Baker and Galloup, also owned by applicant's assignee; and 3,967,661 to Scoville and Tipton all rely upon slitting of the flexible insulation and peeling a portion of the insulation away from the wire. Such prior art devices do not work adequately with the tenacious film insulation normally used on film insulated magnet wire without creating severe conductor damage.

It is therefore a primary object of the present invention to provide a novel and improved wire wrapping tool which overcomes the aforesaid and other problems of the prior art. Another object is to provide a novel and improved wire wrapping tool which is capable of stripping film insulation from magnet wire and producing gas tight wire wrapped electrical connections using film insulated magnet wire.

Still other objects will in part appear obvious and will in part appear herinafter.

The invention accordingly comprises the apparatus processing the features, properties and relations of elements which are exemplified in the following detailed disclosure and the scope of application of which will be indicated in the claims.

SUMMARY OF THE INVENTION

The present invention provides a tool for the completion of a wire wrapped electrical connection form a film insulated magnet wire to an electrical terminal. As mentioned supra, heretofore, the use of magnet wire for wire wrapped connections has not been successful due to the inability of standard wire wrap devices to remove the film insulation to expose the conductor surface. In conventional wire wrap applicatons, the jacket insulation can readily be removed in a single piece, either in a primary removal operation or by the use of a cut, strip and wrap style bit of the type described in the patents mentioned above. In the present invention the film insulated magnet wire is applied directly onto the terminal without prior stripping operations other than by the direct action of the novel wrap bit construction of the present invention.

The present invention is adaptable to hand wrap or machine wrap applications. A typical use of the present invention would be in automotive coils, telecommunications and in general assembly applications where a high quality, efficient and low cost connection is required. The wrapping tool of the present invention is designed to strip a portion of the film insulation from the magnet wire substantially only in the area that contacts the wrap post or connector terminal and wrap the stripped wire around a teminal in a series of helical convolutions with the stripped portion of the wire in intimate electrical contact with the terminal while leaving the outer surfaces of the connection insulated. The tool includes the normal rotatable wrapping bit, having the usual wire receiving groove disposed on the periphery of the bit and a terminal receiving bore in the bit in the center thereof. There is also provided a fixed sleeve surrounding the bit with a wire receiving slot extending outwardly from the sleeve. The bit includes a hook-shaped insulation stripping edge which extends transversely of the wire and is positioned radially inwardly from the wire holding groove. The hook surface has a radius, a portion of which substantially matches the radius of the wire, in part. The stripping edge is also angularly positioned between the groove and the wire receiving slot which extends outwardly through the fixed sleeve. The angular position of the transverse stripping edge controls the tension of the magnet wire as it moves over the hook with the transverse wedge contacting a minor portion, preferably less than 30°, of the film insulation on the circumference of the wire. The wrapping tension causes the wire to bend by at least 30° as it passes over the transverse edge to create a sufficient scraping force to remove a limited portion of the film insulation on that portion of the wire to be brought into contact with the terminal. Thus, with this device, a strong scraping force is provided on the wire to remove a very limited portion of the film insulation which would otherwise lie between the wire and the terminal. With this unique arrangement of the elements of the wire wrapping bit, the very tenacious film insulation is adequately removed from the wire in the limited area thereof which is necessary to permit formation of a good electrical bond between the magnet wire and the terminal, without requiring excessive utilization of power in the wrapping head which might tend to damage or break the wire.

BRIEF DESCRIPTION OF THE DRAWINGS

FIG. 1 is partially sectional, particularly to illustrate the magnet wire and its film insulation and the transverse stripping edge. FIG. 1 shows the relationship of the elements at the start of rotation of the bit, which is to rotate in a clockwise direction.

DESCRIPTION OF A PREFERRED EMBODIMENT OF THE INVENTION

Figure 1:
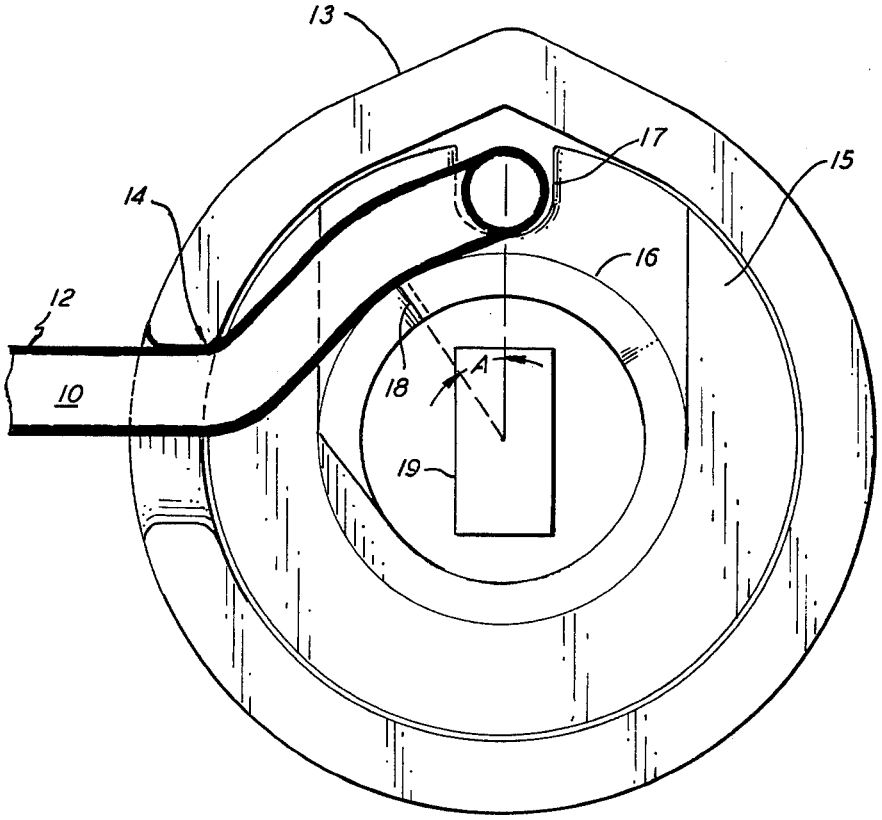
FIG. 1 is a partially schematic, partially sectional end view looking up from a terminal to be wrapped by a tool incorporating the present invention, the invention being applied to a wire wrap tool of the type described in U.S. Pat. No. 3,781,932. For ease of illustration

Referring now to FIG. 1, there is shown a film insulated magnet wire 10 having insulating film 12. The wire extends through a receiving notch 14 which can also act as a wire retaining or anchoring means in outer sleeve 13, which corresponds to the generally tubular sleeve 22 of applicant's prior U.S. Pat. No. 3,781,932. Within the sleeve is the wire wrap bit 15 which carries a stripping element, preferably in the form of an insert shown at 16. The wire receiving groove 17 extends along the bit parallel to the axis of rotation thereof. The insert 16 includes a hook shaped insulation stripping edge 18 which is displaced inwardly from the groove 17 and lies angularly between the groove 17 and the receiving notch or slot 14 through which the wire passes. As seen, there is a slight angle in the wire as it passes over the edge 18 in the starting position shown at FIG. 1. The terminal around which the wire is to be wrapped is shown at 19 and the angle between the center line of the groove 17 and the transverse stripping edge 18 is indicated with the letter A.

Figure 3:
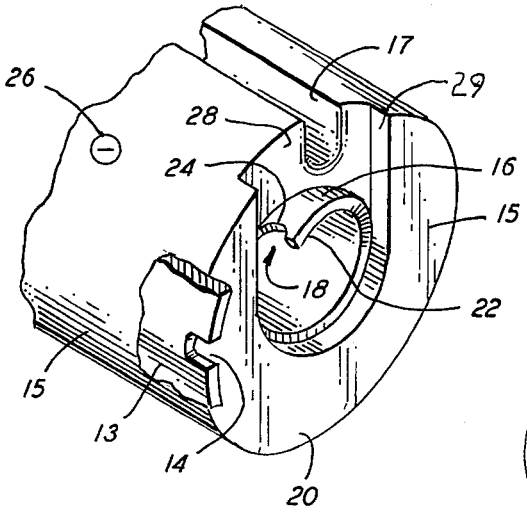
FIG. 3 is a detailed perspective, partially sectional, view of the wire wrapping and stripping bit with the wire removed and showing only a portion of the tool outer sleeve.
Figure 4:
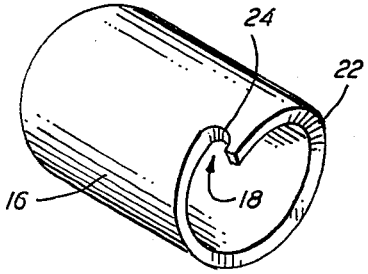
FIG. 4 is a view of a stripping insert showing a replaceable and adjustable insert containing the insulation stripping edge.

Referring now to FIGS. 3 and 4, the details of the wrapping bit are shown in a perspective view with portions of the outer casing removed to illustrate the construction of the inner wrapping bit. The magnet wire is also removed from these Figures. In these drawings the hook shaped scraping edge is shown in the preferred form as being carried by a separate insert which is held in position within the wrapping bit 15 by means, for example, of a mechanical fixing means such as a locking screw 26 or adhesive means (not shown) which permits adjustment of the angle A between the scraping edge 18 and the wire groove 17. As shown, the insert 16 has a curved, arcuate edge 24 constituting the scraping edge 18, this edge 24 extending radially outwardly from the center. The end face of the insert at 22 is smoothed so as to prevent damage to the magnet wire as it is helically wound on the terminal. The face of the wire wrap bit 15 is indented at 29 to provide a space 28 through which the wire can pass from the groove 17, over the scraping edge 18, and out through the receiving slot 14 in the outer fixed sleeve 13, only a portion of sleeve 13 being shown.

Figure 2:
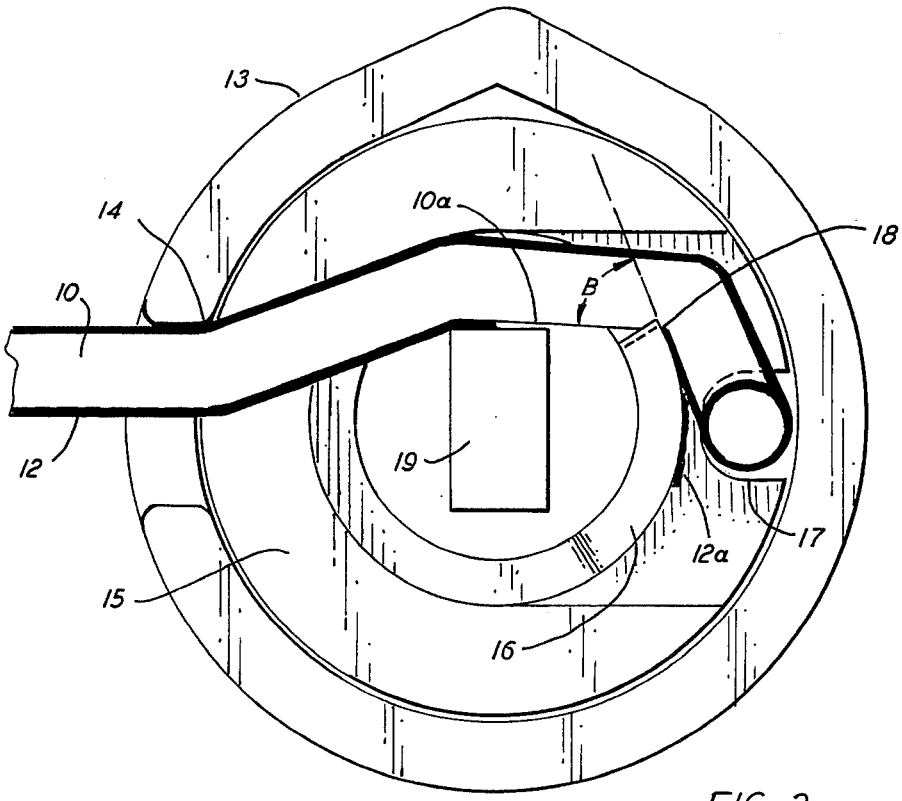
FIG. 2 is a view similar to FIG. 1 but showing the relationship of the elements of the combination after the bit has rotated 90°.

Referring now to FIG. 2, it can be seen how the elements described above cooperate to strip a limited portion of the film insulation from the inner surface of the magnet wire as it is wrapped around the terminal 19. In FIG. 2 the bit has rotated 90° to the right and it can be seen how the wire 10 has been bent sharply around and over the edge of the hook shaped scraping and stripping edge 18, the removed film insulation being shown at 12*a*. As can be seen, only a small portion of the film insulation (preferably less than 30° of circumference thereof) has been removed from the wire, the bare portion of wire being indicated at 10*a*. As the bit continues to rotate in a clockwise direction, the wire is wrapped tightly around the terminal 19 and the film insulation on the inner face of the magnet wire is scraped from the wire as the wire is drawn across the narrow stripping edge 18. The sharp angle at which the magnet wire is bent over the stripping edge creates a very concentrated pressure point which is sufficient to remove the various type of film insulation normally employed for insulating magnet wire.

In a preferred invention, the angle A between the groove 17 of the wrapping bit and the location of the stripping edge 18 is adjusted to provide sufficient pressure to remove insulation without otherwise damaging the conductor. As is known in the art, different wires will require different pressure, depending on wire gauge (size), and type and thickness of insulating film. The greater this angle, the greater will be the unit force on the edge; however, it is not desired to have this angle greater than that required to produce force substantially in excess of that required to remove the insulation. In this latter case the magnet wire may be unduly damaged or broken by the insulation stripping operation.

As pointed out earlier, this invention may be applied to many of the standard prior art devices which can be hand powered, electrically powered or automatic wire wrapping machines. These features, however, are not part of the invention and, since they are well known in the art, are not described herein.

The portion of the wire which extends through the opening 14 can be held by the opening 14 itself, if the opening is wedge-shaped. Equally the end of the wire can be held by the operator or by some device on the system being worked on such as by a previous winding wherein a number of terminals are connected together by a common wire, such as is shown in the system of FIG. 8 of the above-mentioned U.S. Pat. No. 4,327,781.

As can be seen, particularly from FIG. 2, the wire 10 runs essentially parallel to the outer surface of the scraping hook 18 and this wire is bent over the scraping edge by an angle (illustrated at B in FIG. 2). This angle B is determined by the diagonal of the terminal 19, the radial spacing of the outer scraping edge 18 from the center of the terminal 19 and the size of wire used, i.e. the angular displacement between scraping edge 18 and the axis of the groove 17. As can be seen, the wire 10 is essentially tangent to the outer surface of the hook shaped knife 18 and the scraping edge is essentially perpendicular to the insulation. As the wire bends around this edge, while passing over the edge, it concentrates the force of the edge on a very narrow region of the insulation and is effective to scrape the tenacious film insulation from the wire 10 just prior to being wrapped around the terminal 19.

SUMMARY

As may be appreciated from the foregoing description, the improved wire wrapping tool of the present invention may be advantageously employed for the production of wire wrap electrical connections using film insulated magnet wires. However, the same tool may be advantageously employed making wire wrap electrical connections of other thin gauge insulated wires having conventional, i.e. synthetic polymer insulating sleeves. A particular feature and advantage of the present invention resides in the fact that the insert 16 may be readily removed from the tool so as to permit remachining or replacement at nominal user expense. Moreover, angular displacement of the scraping hook 18 may readily be accomplished. Still other changes will be obvious to one skilled in the art. Accordingly, it is intended that all matter contained in the above description or shown in the accompanying drawings shall be interpreted in an illustrative and not in a limiting sense.

We claim:

1. In a device for stripping insulation from wire and wrapping said stripped wire around a terminal in a series of helical convolutions wherein the device includes a rotatable wrapping bit having a wire receiving groove disposed on the periphery of the bit and radially offset from a terminal receiving bore in said bit at the end thereof and a fixed sleeve surrounding said bit with a wire anchoring slot extending outwardly therefrom, the improvement wherein said bit includes an adjustable insert having a free end and a portion within said bit surrounding and defining the terminal receiving bore, said insert having a hook shaped insulation stripping edge protruding beyond a surface of said bit and positioned axially inward of the free end of said insert, radially inwardly of said groove and angularly positioned between said groove and said anchoring slot, the angular position being adjustable by rotating said insert within said bit and thereby controlling the tension of said wire as it moves over said hook, a portion of the radius of the hook surface substantially matching the radius of the wire.

2. In a device according to claim 1, the improvement which comprises means for fixedly locating and retaining said insert within said bit.

3. In a device according to claim 2, the improvement wherein said means for locating and retaining comprises adhesive means.

4. In a device according to claim 2, the improvement wherein said locating means comprises a locking screw.

5. In a device for stripping insulation from wire and wrapping said stripped wire around a terminal in a series of helical convolutions wherein the device includes a rotatable wrapping bit having a wire receiving passage extending generally parallel to the axis of the bit and radially offset from a terminal receiving bore in said bit at the end thereof and a fixed sleeve surrounding said bit with a second wire passage extending outwardly therefrom, the improvement wherein said bit includes an adjustable insert having a free end and a hook shaped insulation stripping edge protruding beyond a surface of said bit and positioned axially inward of the free end of said insert and radially inwardly of said groove and angularly positioned between said groove and said second passage, the angular position being adjustable by rotating said insert within said bit thereby controlling the tension of said wire as it moves over said hook, said edge contacting a minor portion of the circumference of the wire, the wrapping tension causing the wire to bend as it passes over said transverse edge to create a scraping force of sufficient magnitude to remove a limited portion of said film insulation on that surface of the wire to be brought into contact with said terminal.

6. In a device according to claim 5, the improvement which comprises means for fixedly locating said insert within said bit.

7. In a device according to claim 6, the improvement wherein said means for locating comprises adhesive means.

8. In a device according to claim 6, the improvement wherein said locating means comprises a locking screw.

9. In a device for stripping film insulation from wire and wrapping said stripped wire around a terminal in a series of helical convolutions wherein the device includes a rotatable wrapping bit having a means for feeding wire along the bit, said means being radially offset from a terminal receiving bore in said bit at the end thereof and a fixed sleeve surrounding said bit with a wire passage extending outwardly therefrom, the improvement wherein said bit includes an adjustable insert having a free end and a hook shaped insulation stripping edge protruding beyond a surface of said bit and positioned axially inward of the free end of said insert, radially inwardly of said groove and angularly positioned between said wire feeding means and said passage, the angular position being adjustable by rotating said insert within said bit thereby controlling the tension of said wire as it moves over said hook, said edge contacting a minor portion of the circumference of the wire, the wrapping tension causing the wire to bend as it passes over said transverse edge to create a scraping force of sufficient magnitude to remove a limited portion of said insulation on that surface of the wire to be brought into contact with said terminal.

10. In a device according to claim 9, the improvement which comprises means for fixedly locating said insert within said bit.

11. In a device according to claim 10, the improvement wherein said means for locating comprises adhesive means.

12. In a device according to claim 10, the improvement wherein said locating means comprises a locking screw.

13. In a device for stripping film insulation from wire and wrapping said stripped wire around a terminal in a series of helical convolutions wherein the device includes a rotatable wrapping bit having a means for feeding wire along the bit, said means being radially offset from a terminal receiving bore in said bit at the end thereof and a fixed sleeve surrounding said bit with a wire passage for receiving a portion of the wire which is to be held stationery as the wrapping bit rotates, the improvement wherein said bit incudes an adjustable insert having a free end and a hook shaped insulation scraping edge protruding beyond a surface of said bit and positioned axially inward of the free end of said insert, radially inwardly of said groove and angularly positioned between said wire feeding means and said passage, an outer circumferential face on said hook terminating in said scraping edge, the angular position being sufficient to permit the wire to be approximately tangent to the circumferential face adjacent the scraping edge and being adjustable by rotating said insert within said bit thereby controlling the tension of said wire as it moves over said hook, said edge contacting a minor portion of the circumference of the wire, the wrapping tension causing the wire to bend as it passes over said transverse edge to create a scraping force of sufficient magnitude to remove a limited portion of said film insulation on that surface of the wire to be brought into contact with said terminal.

14. In a device according to claim 13, the improvement which comprises means for fixedly locating said insert within said bit.

15. In a device according to claim 14, the improvement wherein said means for locating comprises adhesive means.

16. In a device according to claim 14, the improvement wherein said locating means comprises a locking screw.

* * * * *